US010371004B2

(12) United States Patent
Casu et al.

(10) Patent No.: US 10,371,004 B2
(45) Date of Patent: Aug. 6, 2019

(54) LAYER SYSTEM WITH A STRUCTURED SUBSTRATE SURFACE AND PRODUCTION PROCESS

(75) Inventors: Alessandro Casu, Duisburg (DE); Oliver Lusebrink, Witten (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 942 days.

(21) Appl. No.: 14/354,571

(22) PCT Filed: Sep. 14, 2012

(86) PCT No.: PCT/EP2012/068055

§ 371 (c)(1),
(2), (4) Date: Apr. 26, 2014

(87) PCT Pub. No.: WO2013/072092

PCT Pub. Date: May 23, 2013

(65) Prior Publication Data

US 2014/0302282 A1 Oct. 9, 2014

(30) Foreign Application Priority Data

Nov. 14, 2011 (EP) ..... 11188983

(51) Int. Cl.

| | |
|---|---|
| ***F01D 25/00*** | (2006.01) |
| ***F01D 5/28*** | (2006.01) |
| ***C23C 4/00*** | (2016.01) |
| ***C23C 28/00*** | (2006.01) |

(52) U.S. Cl.

CPC ..... *F01D 25/005* (2013.01); *C23C 4/00* (2013.01); *C23C 28/3215* (2013.01);
(Continued)

(58) Field of Classification Search

CPC ... F01D 25/005; F01D 5/282; C23C 28/3215; C23C 28/345; C23C 28/3455; C23C 4/00; Y10T 428/24355

See application file for complete search history.

(56) References Cited

U.S. PATENT DOCUMENTS 5,817,372 A * 10/1998 Zheng ..... C23C 4/02 427/454
6,024,792 A 2/2000 Hans-Werner
2002/0146541 A1* 10/2002 Fried ..... B22C 7/02 428/172

FOREIGN PATENT DOCUMENTS

DE 102005050873 A1 * 4/2007 ..... C23C 4/02
DE 102008009504 A1 8/2009

(Continued)

OTHER PUBLICATIONS

English Translation of DE 102005050873 A1. accessed Jan. 24, 2017.*

*Primary Examiner* — Nancy R Johnson
(74) *Attorney, Agent, or Firm* — Beusse Wolter Sanks & Maire

(57) ABSTRACT

A layer system is provided having at least two layers, an inner layer on a boundary surface of a substrate, wherein the inner layer has a certain roughness in a region of the surface to an outer layer due to a coating processes, wherein a roughness of the boundary surface of the substrate is set in a targeted manner, or the boundary surface is machined, after it has been produced, such that the roughness of the boundary surface of the substrate has peaks and troughs that are at least 20% greater than the roughness of the interface if peaks and troughs were not to be present. As a result of the structured surface of the substrate, this roughness becomes
(Continued)

positioned on an interface of the layers located above, and the adhesion of the layers to one another is thereby improved.

24 Claims, 6 Drawing Sheets

(52) U.S. Cl.
CPC ..... *C23C 28/345* (2013.01); *C23C 28/3455* (2013.01); *F01D 5/282* (2013.01); *Y10T 428/24355* (2015.01)

(56) References Cited

FOREIGN PATENT DOCUMENTS

| | | | |
|---|---|---|---|
| EP | 0412397 | A1 | 2/1991 |
| EP | 0486489 | B1 | 11/1994 |
| EP | 0892090 | A1 | 1/1999 |
| EP | 0786017 | B1 | 3/1999 |
| EP | 1048751 | A1 | 11/2000 |
| EP | 1306454 | A1 | 5/2003 |
| EP | 1319729 | A1 | 6/2003 |
| EP | 1204776 | B1 | 6/2004 |
| EP | 1939317 | A2 | 7/2008 |
| EP | 2128300 | A1 | 12/2009 |
| WO | 9967435 | A1 | 12/1999 |
| WO | 0044949 | A1 | 8/2000 |
| WO | 2008049460 | A1 | 5/2008 |
| WO | 2011070557 | A2 | 6/2011 |
| WO | 2011071974 | A2 | 6/2011 |

* cited by examiner

FIG 6

| Material | Chemical composition in % | | | | | | | | | | | | |
|---|---|---|---|---|---|---|---|---|---|---|---|---|---|
| | C | Cr | Ni | Co | Mo | W | Ta | Nb | Al | Ti | B | Zr | Hf |
| Ni-based investment casting alloys | | | | | | | | | | | | | |
| GTD 222 | 0.10 | 22.5 | Rem. | 19.0 | | 2.0 | 1.0 | | 1.2 | 2.3 | 0.008 | | |
| IN 939 | 0.15 | 22.4 | Rem. | 19.0 | | 2.0 | 1.4 | 1.0 | 1.9 | 3.7 | 0.009 | 0.10 | |
| IN 6203 DS | 0.15 | 22.0 | Rem. | 19.0 | | 2.0 | 1.1 | 0.8 | 2.3 | 3.5 | 0.010 | 0.10 | 0.75 |
| Udimet 500 | 0.10 | 18.0 | Rem. | 18.5 | 4.0 | | | | 2.9 | 2.9 | 0.006 | 0.05 | |
| IN 738 LC | 0.10 | 16.0 | Rem. | 8.5 | 1.7 | 2.6 | 1.7 | 0.9 | 3.4 | 3.4 | 0.010 | 0.10 | |
| SC 16 | <0.01 | 16.0 | Rem. | | 3.0 | | 3.5 | | 3.5 | 3.5 | <0.005 | <0.008 | |
| Rene 80 | 0.17 | 14.0 | Rem. | 9.5 | 4.0 | 4.0 | | | 3.0 | 5.0 | 0.015 | 0.03 | |
| GTD 111 | 0.10 | 14.0 | Rem. | 9.5 | 1.5 | 3.8 | 2.8 | | 3.0 | 4.9 | 0.012 | 0.03 | |
| GTD 111 DS | | | | | | | | | | | | | |
| IN 792 CC | 0.08 | 12.5 | Rem. | 9.0 | 1.9 | 4.1 | 4.1 | | 3.4 | 3.8 | 0.015 | 0.02 | |
| IN 792 DS | 0.08 | 12.5 | Rem. | 9.0 | 1.9 | 4.1 | 4.1 | | 3.4 | 3.8 | 0.015 | 0.02 | 1.00 |
| MAR M 002 | 0.15 | 9.0 | Rem. | 10.0 | | 10.0 | 2.5 | | 5.5 | 1.5 | 0.015 | 0.05 | 1.50 |
| MAR M 247 LC DS | 0.07 | 8.1 | Rem. | 9.2 | 0.5 | 9.5 | 3.2 | | 5.6 | 0.7 | 0.015 | 0.02 | 1.40 |
| CMSX-2 | <.006 | 8.0 | Rem. | 4.6 | 0.6 | 8.0 | 6.0 | | 5.6 | 1.0 | <.003 | <.0075 | |
| CMSX-3 | <.006 | 8.0 | Rem. | 4.6 | 0.6 | 8.0 | 6.0 | | 5.6 | 1.0 | <.003 | <.0075 | 0.10 |
| CMSX-4 | | 6.0 | Rem. | 10.0 | 0.6 | 6.0 | 6.0 | | 5.6 | 1.0 | | Re=3.0 | 0.10 |
| CMSX-6 | <.015 | 10.0 | Rem. | 5.0 | 3.0 | <.10 | 2.0 | <.10 | 4.9 | 4.8 | <.003 | <.0075 | 0.10 |
| PWA 1480 SX | <.006 | 10.0 | Rem. | 5.0 | | 4.0 | 12.0 | | 5.0 | 1.5 | <.0075 | <.0075 | |
| PWA 1483 SX | 0.07 | 12.2 | Rem. | 9.0 | 1.9 | 3.8 | 5.0 | | 3.6 | 4.2 | 0.0001 | 0.002 | |
| Co-based investment casting alloys | | | | | | | | | | | | | |
| FSX 414 | 0.25 | 29.0 | 10 | Rem. | | 7.5 | | | | | 0.010 | | |
| X 45 | 0.25 | 25.0 | 10 | Rem. | | 8.0 | | | | | 0.010 | | |
| ECY 768 | 0.65 | 24.0 | 10 | 51.7 | | 7.5 | 4.0 | | 0.25 | 0.3 | 0.010 | 0.05 | |
| MAR-M-509 | 0.65 | 24.5 | 11 | Rem. | | 7.5 | 4 | | | 0.3 | 0.010 | 0.60 | |
| CM 247 | 0.07 | 8.3 | Rem. | 10.0 | 0.5 | 9.5 | 3.2 | | 5.5 | 0.7 | | | 1.5 |

LAYER SYSTEM WITH A STRUCTURED SUBSTRATE SURFACE AND PRODUCTION PROCESS

CROSS REFERENCE TO RELATED APPLICATIONS

This application is the U.S. National Stage of International Application No. PCT/EP2012/068055 filed Sep. 14, 2012, and claims the benefit thereof. The International Application claims the benefit of European Application No EP11188983 filed Nov. 14, 2011. All of the applications are incorporated by reference herein in their entirety.

FIELD OF INVENTION

The invention relates to a layer system and to a production process, in which the substrate surface has a greater roughness than an interface between the layers.

BACKGROUND OF INVENTION

Components for high-temperature applications have to be protected against excessively high heat input. This is preferably done by layers in which an outer ceramic layer is applied to a metallic bonding layer which has been applied to a metallic substrate.

Depending on the way in which the ceramic layer is applied, the roughness of the metallic bonding layer plays a crucial role for the service life of the ceramic thermal barrier layer.

SUMMARY OF INVENTION

It is therefore an object of the present invention to further improve the solution mentioned above.

The object is achieved by a layer system as claimed and by a process for producing a layer system as claimed.

The dependent claims list further advantageous measures which can be combined with one another, as desired, in order to achieve further advantages.

BRIEF DESCRIPTION OF THE DRAWINGS

FIG. 6 shows a list of superalloys.

The description and the figures represent merely exemplary embodiments of the invention.

DETAILED DESCRIPTION OF INVENTION

Figure 1:
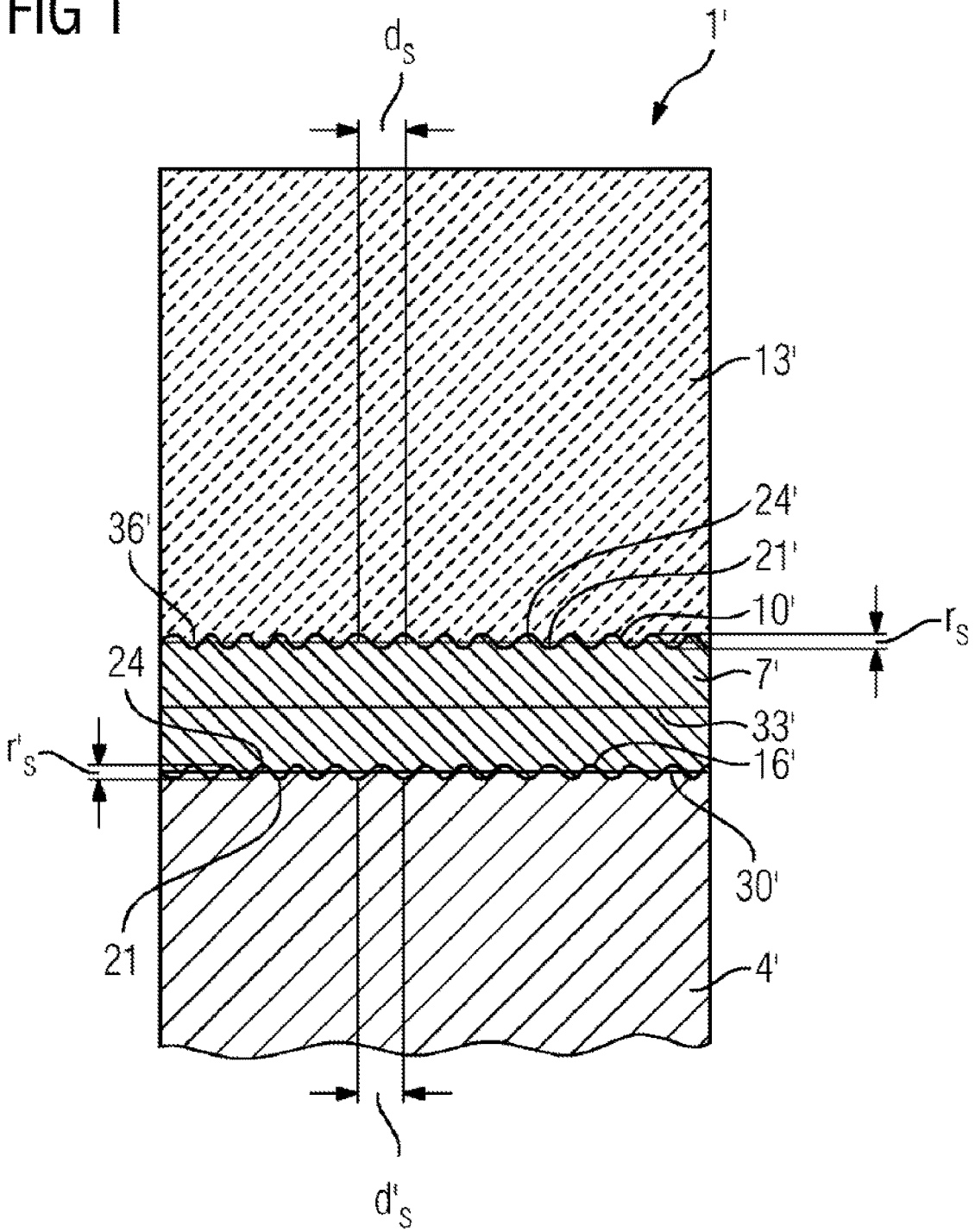
FIG. 1 shows a layer system according to the prior art.

FIG. 1 shows a layer system 1' according to the prior art.

A metallic bonding layer 7' (MCrAlX) having a certain roughness at its surface 10' to the outer layer, a ceramic thermal barrier layer 13', is applied to a substrate 4'. This roughness arises on account of the known coating processes, in particular as a result of thermal coating processes, very particularly as a result of plasma spraying (APS, VPS, LPPS) or as a result of HVOF.

Figure 4:
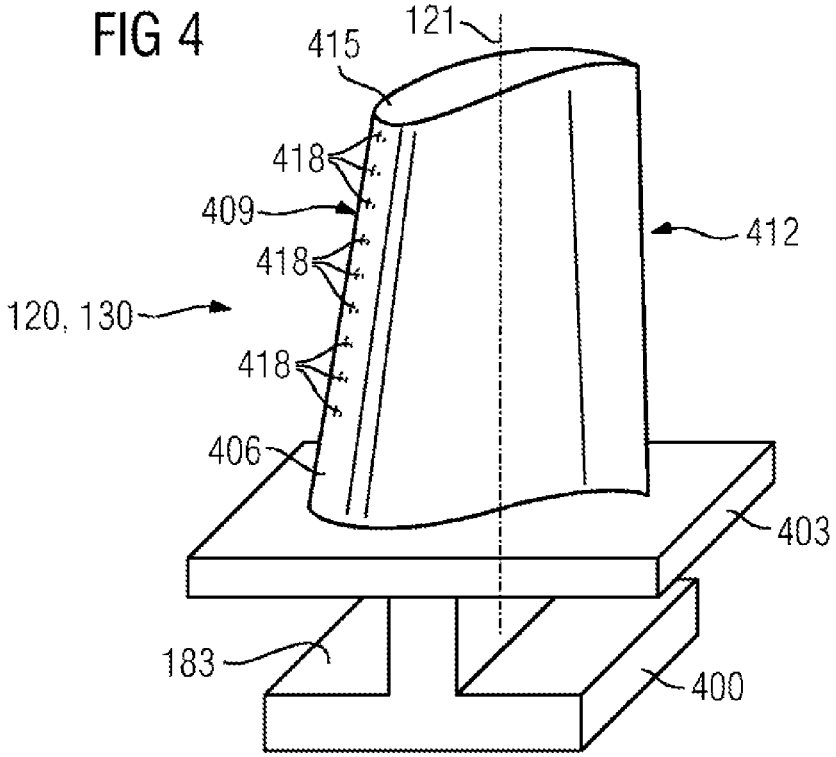
FIG. 4 shows a turbine blade or vane.

FIG. 1 is a simplified illustration because the substrate 4 is curved when used in a main blade or vane part 406 (FIG. 4) of a turbine blade or vane 120, 130 (FIG. 4).

The maximum difference between the highest elevation 24' and the deepest depression 21' of the rough surface 10' of the layer 7' according to the prior art is $r_s$. The highest elevation 24' and the deepest depression 21' for these maximum/minimum values for $r_s$ do not have to be adjacent.

The maximum distance measured from tip to tip between two directly adjacent elevations 24' of the rough surface 10' of the layer 7' is $d_s$.

The values $r_s$, $d_s$ are given by the coating, i.e. by the coating process, parameter, powder, . . . .

The structure (roughness) of the surface 10' is irregular and therefore does not have a periodicity.

The same definition applies to the rough surface 16' of the substrate 4', with $r'_s$ (maximum difference between the highest elevation 24 and the deepest depression 21 of the rough surface 16' of the substrate 4'; analogous to $r_s$) and $d'_s$ (maximum distance between two tips of two directly adjacent elevations 24 of the substrate 4'; analogous to $d_s$). The values $r'_s$ and $d'_s$ are given by the casting or machining, smoothing of the substrate 4'.

A mean value line of elevations 24' and depressions 21' of the rough surface 10' would run between the highest elevation 24' and the deepest depression 21' of the rough surface 10'. The same applies to the surface 16' of the substrate 4'. The values $r_s$ and $r'_s$ and respectively $d_s$ and $d'_s$ are not necessarily the same.

A substrate centerline 30' of the surface 16' of the substrate 4', i.e. a line representing the mean value of the elevations 24' and depressions 21' of the rough surface 16', a layer thickness centerline 33' of the layer 7', i.e. a line running in the center of the layer 7', and a layer surface centerline 36', i.e. a line representing the mean value of the elevations 24 and the depressions 21 of the rough surface 10' of the substrate, run rectilinearly.

Figure 7:
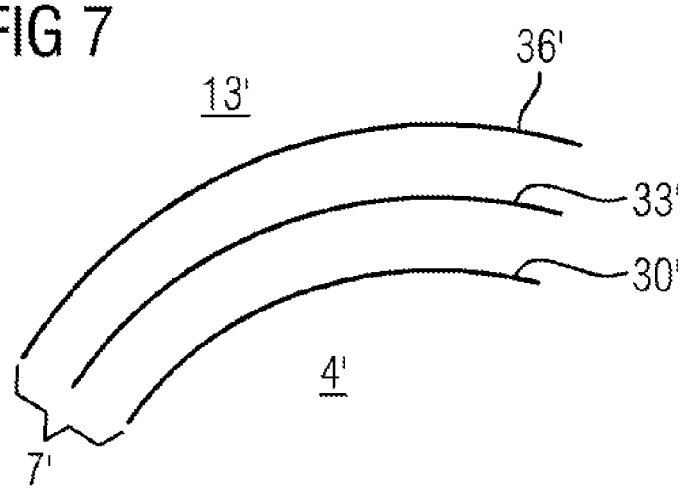

In the case of the actual component 120, 130 on the main blade or vane part, said lines 30', 33', 36' are bent once (FIG. 7), or they run like a surface of a component 120, 130 according to the prior art.

Figure 2:
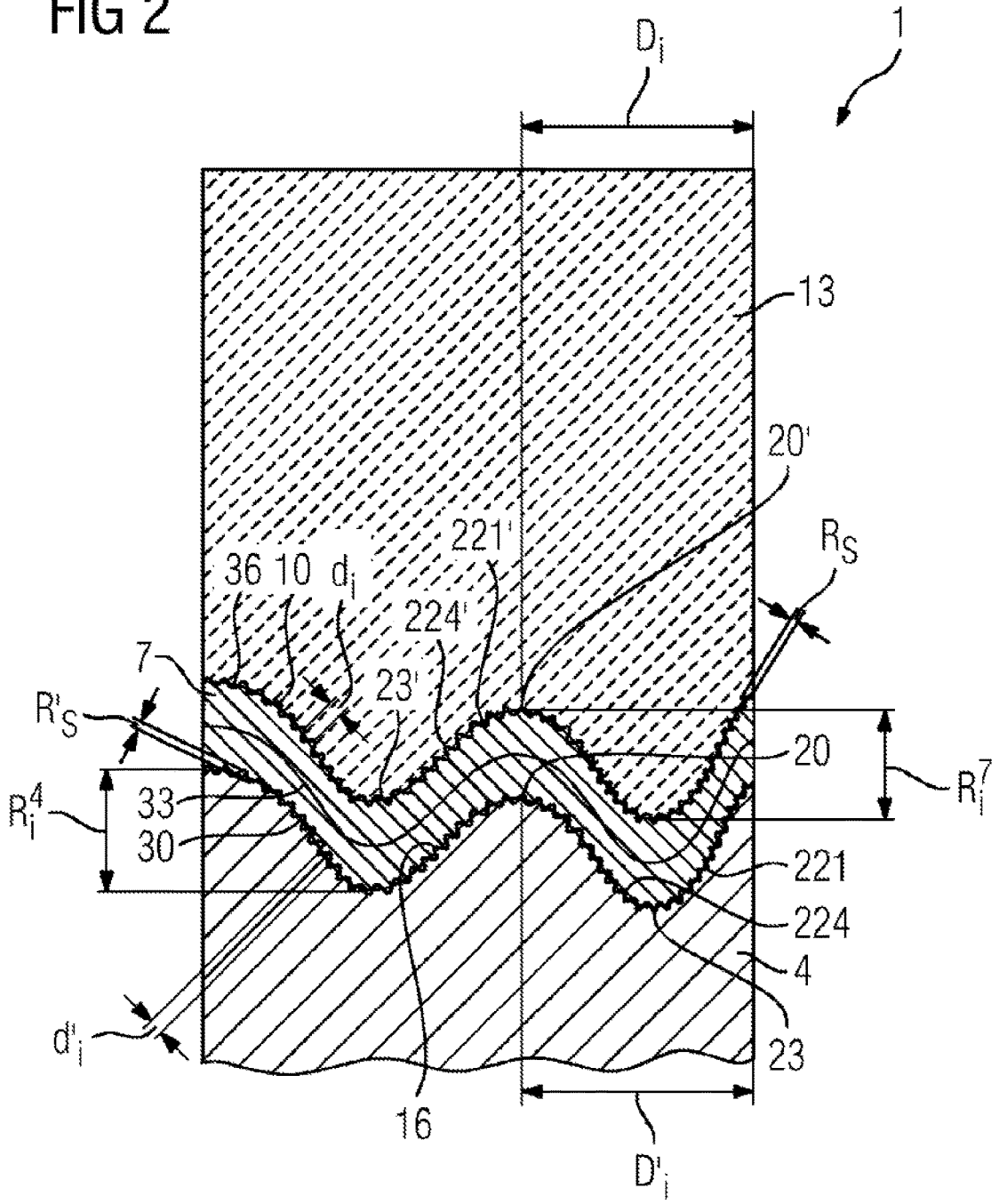
FIGS. 2, 7 and 8 show a layer system according to the invention.

By contrast, the layer system 1 according to the invention as shown in FIG. 2 has a substrate 4, in which the structure of the boundary surface 16 of the substrate 4, and therefore also the boundary surface 10 of the layer 7 to which a ceramic coating 13 is applied, have been changed in a targeted and controlled manner.

The boundary surface 16 of the substrate 4 has a different structure, i.e. a higher roughness than the surface 16' (between the substrate 4' and the layer 7') according to the prior art (FIG. 1).

A trough 23 and a peak 20 or troughs and peaks give the boundary surface 16 of the substrate 4 a rougher configuration, this having been formed so to speak by a wavy nature of a substrate 4', and enlarge the boundary surface 16 compared to the surface 16' of the substrate 4' (FIG. 1).

Figure 8:
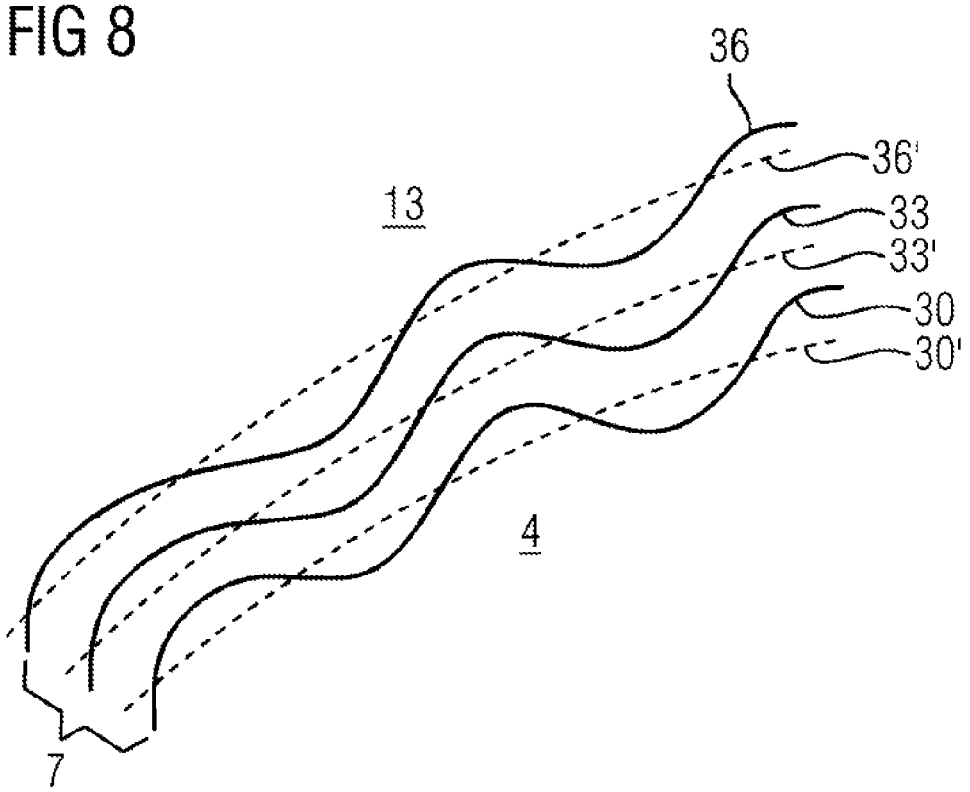

A substrate surface centerline 30 of the boundary surface 16, i.e. a line representing the mean value of elevations 224 and depressions 221, or a layer thickness centerline 33 of the layer 7 or a surface centerline 36 of the layer 7 (definition of 30, 33, 36 as in the case of 30', 33', 36') do not run rectilinearly, but rather in a wavy form, in which case they have at least 5 waves (FIG. 8), in particular have a periodic wave formation. A mean value line through peaks 20 and troughs 23 would similarly run as in the prior art.

A lesser roughness ($R_s$=minimum difference between the highest elevation 224' of the layer 7 and the deepest depression 221' of the layer 7), as is known from the prior art, is also superposed on the peak 20 and on the trough 23.

The difference between a highest peak 20 and a deepest trough 23 (incidentally in direct succession in FIG. 2) of the substrate 4, which have been formed by the wavy nature of a substrate 4' according to the prior art, is $R^4_i$.

The preferably wave-like boundary surface 16 also has the superposed roughness $R_s$, but this is smaller than the roughness $R_i^4$ of the substrate 4 which is set in a targeted manner.

The maximum distance between an adjacent peak 20 and trough 23 of the substrate 4 is D'i. This similarly applies to the surface 10 of the layer 7, with $D_i$.

$D'_i$ (maximum distance between peak 20' and trough 23' of the layer 7) is comparable to $D_i$.

The value $d'_i$, i.e. the maximum distance between two tips of adjacent elevations 224 of the wavy, rough surface 16', here then the boundary surface 16, is comparable to $d'_s$.

$R^7_i$ has a corresponding definition. The value $R^7_i$ is comparable to the value $R^4_i$, since the metallic layer 7 does not compensate for the peaks 20 and troughs 23 of the surface 16 of the substrate 4.

Similarly, the value $R'_s$, i.e. the maximum difference between the highest elevation 224 and the deepest depression 221 of the wavy, rough surface 16', that is here the boundary surface 16, is comparable to $r'_s$.

The rough surface 10' of a layer 7' (FIG. 1) is therefore as it were additionally only provided with a wavy formation toward the bonding layer 7, and therefore has comparable values $d_s$ (FIG. 1) for $d_i$ (=maximum distance between two adjacent elevations 224').

The value $R_s$, i.e. the maximum difference between the highest elevation 224' and the deepest depression 221' of the layer 7, for the interface 10 is comparable to the value $r_s$ from the prior art (FIG. 1), given the same coating technique and the same powder.

To determine the roughness, it is also possible to use the root-mean-squared or mean roughness (Rq or Ra).

The roughness of the surface 16 of the substrate 4 is preferably at least 20%, in particular 30%, rougher than the interface 10' between the layers 7', 13' according to the prior art (FIG. 1), i.e. the value $R^7_i$ or $R^4_i$ is at least 20%, in particular 30%, greater than the value $r_s$ or $r'_s$.

The roughness with trough 23 and peak 20 of the substrate 4 preferably has a uniform form at least in places, i.e. is for example sinusoidal, or has at least a constant wave length (waviness) or constant distances between directly adjacent peaks. The unmachined surface 16' in particular does not have a uniformity or periodicity.

The waviness of the boundary surface 16 of the substrate 4 is preferably greater than that of the surface 10' according to the prior art, i.e. at least 20%, i.e. the distances between two "peaks" 20 are greater. The smallest distance $D_i$ (FIG. 2) between adjacent peaks 20 is at least 20%, in particular 30%, greater than the greatest distance $d_i$ (or $d_s$) between adjacent elevations for the boundary surface 10.

The waviness of the boundary surface 16 of the substrate 4 also continues through the coating 7 at the boundary surface 10 with the peak 20' of the layer 7 and trough 23 of the layer 7.

As a result of the superposition of the greater roughness or waviness of the boundary surface 16 of the substrate 4 and the roughness of the inner, in particular metallic, bonding layer 7, the adhesion of the overlying layer 13 is furthermore improved.

The substrate 4 can be structured over the entire boundary surface 16, or else only locally. In the case of a turbine blade or vane 120, 130, this would be the main blade or vane part 406.

The substrate 4 preferably comprises a cobalt-based or nickel-based alloy, in particular from FIG. 6.

The substrate 4 can already have the desired structure on the boundary surface 16 after casting by virtue of an appropriately shaped casting mold, or it is machined after the casting, in particular by laser machining, in order to establish the desired surface structure.

Figure 3:
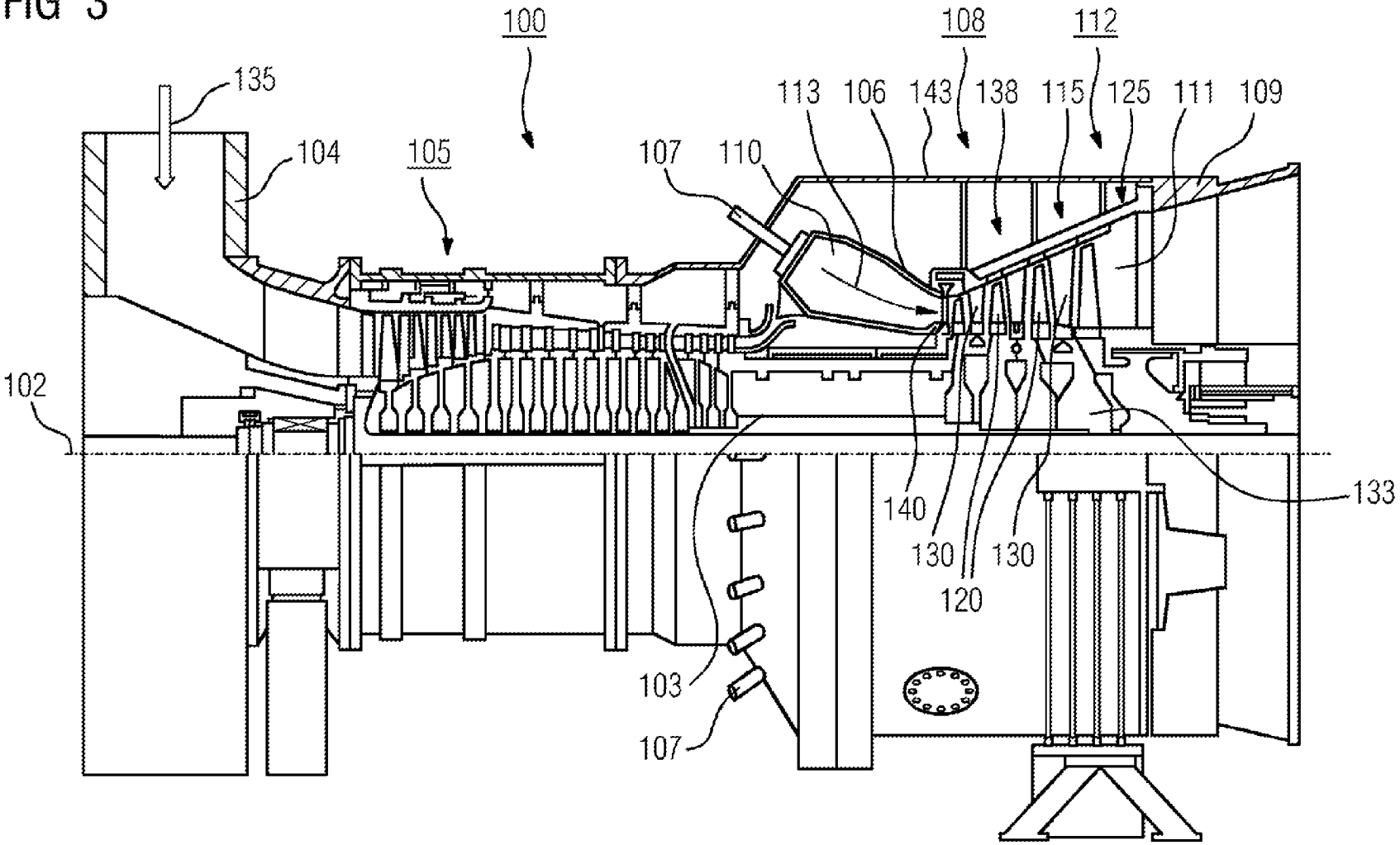
FIG. 3 shows a gas turbine.

FIG. 3 shows by way of example a partial longitudinal section through a gas turbine 100.

In its interior, the gas turbine 100 has a rotor 103 which is mounted such that it can rotate about an axis of rotation 102, has a shaft 101, and is also referred to as the turbine rotor.

An intake housing 104, a compressor 105, a for example toroidal combustion chamber 110, in particular an annular combustion chamber, with a plurality of coaxially arranged burners 107, a turbine 108 and the exhaust gas housing 109 follow one another along the rotor 103.

The annular combustion chamber 110 is in communication with a for example annular hot gas duct 111. There, by way of example, four successive turbine stages 112 form the turbine 108.

Each turbine stage 112 is formed for example from two blade or vane rings. As seen in the direction of flow of a working medium 113, a guide vane row 115 is followed in the hot gas duct 111 by a row 125 formed from rotor blades 120.

The guide vanes 130 are secured to an inner housing 138 of a stator 143, whereas the rotor blades 120 of a row 125 are fitted on the rotor 103, for example by a turbine disk 133.

A generator (not shown) is coupled to the rotor 103.

While the gas turbine 100 is operating, air 135 is drawn in through the intake housing 104 and compressed by the compressor 105. The compressed air provided at the turbine end of the compressor 105 is passed to the burners 107, where it is mixed with a fuel. The mixture is then burnt in the combustion chamber 110, forming the working medium 113. From there, the working medium 113 flows along the hot gas duct 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield elements which line the annular combustion chamber 110, are subject to the highest thermal stresses.

To be able to withstand the temperatures which prevail there, they can be cooled by a coolant.

Substrates of the components may likewise have a directional structure, i.e. they are in single-crystal form (SX structure) or have only longitudinally oriented grains (DS structure).

By way of example, iron-based, nickel-based or cobalt-based superalloys are used as material for the components, in particular for the turbine blade or vane 120, 130 and components of the combustion chamber 110.

Superalloys of this type are known for example from EP 1 204 776 B1, EP 1 306 454, EP 1 319 729 A1, WO 99/67435 or WO 00/44949.

The blades or vanes 120, 130 may likewise have coatings protecting against corrosion (MCrAlX; M is at least one element selected from the group consisting of iron (Fe), cobalt (Co), nickel (Ni), X is an active element and stands for yttrium (Y) and/or silicon, scandium (Sc) and/or at least one rare earth element, or hafnium). Alloys of this type are known from EP 0 486 489 B1, EP 0 786 017 B1, EP 0 412 397 B1 or EP 1 306 454 A1.

A thermal barrier layer, consisting for example of $ZrO_2$, $Y_2O_3$—$ZrO_2$, i.e. unstabilized, partially stabilized or fully stabilized by yttrium oxide and/or calcium oxide and/or magnesium oxide, may also be present on the MCrAlX.

Columnar grains are produced in the thermal barrier layer by suitable coating processes, such as for example electron beam physical vapor deposition (EB-PVD).

The guide vane 130 has a guide vane root (not shown here), which faces the inner housing 138 of the turbine 108, and a guide vane head which is at the opposite end from the guide vane root. The guide vane head faces the rotor 103 and is fixed to a securing ring 140 of the stator 143.

FIG. 4 shows a perspective view of a rotor blade 120 or guide vane 130 of a turbomachine, which extends along a longitudinal axis 121.

The turbomachine may be a gas turbine of an aircraft or of a power plant for generating electricity, a steam turbine or a compressor.

The blade or vane 120, 130 has, in succession along the longitudinal axis 121, a securing region 400, an adjoining blade or vane platform 403 and a main blade or vane part 406 and a blade or vane tip 415.

As a guide vane 130, the vane 130 may have a further platform (not shown) at its vane tip 415.

A blade or vane root 183, which is used to secure the rotor blades 120, 130 to a shaft or a disk (not shown), is formed in the securing region 400.

The blade or vane root 183 is designed, for example, in hammerhead form. Other configurations, such as a fir-tree or dovetail root, are possible.

The blade or vane 120, 130 has a leading edge 409 and a trailing edge 412 for a medium which flows past the main blade or vane part 406.

In the case of conventional blades or vanes 120, 130, by way of example solid metallic materials, in particular superalloys, are used in all regions 400, 403, 406 of the blade or vane 120, 130.

Superalloys of this type are known, for example, from EP 1 204 776 B1, EP 1 306 454, EP 1 319 729 A1, WO 99/67435 or WO 00/44949.

The blade or vane 120, 130 may in this case be produced by a casting process, by directional solidification, by a forging process, by a milling process or combinations thereof.

Workpieces with a single-crystal structure or structures are used as components for machines which, in operation, are exposed to high mechanical, thermal and/or chemical stresses.

Single-crystal workpieces of this type are produced, for example, by directional solidification from the melt. This involves casting processes in which the liquid metallic alloy solidifies to form the single-crystal structure, i.e. the single-crystal workpiece, or solidifies directionally.

In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified microstructures (directionally solidified structures).

Processes of this type are known from U.S. Pat. No. 6,024,792 and EP 0 892 090 A1.

The blades or vanes 120, 130 may likewise have coatings protecting against corrosion or oxidation e.g. (MCrAlX; M is at least one element selected from the group consisting of iron (Fe), cobalt (Co), nickel (Ni), X is an active element and stands for yttrium (Y) and/or silicon and/or at least one rare earth element, or hafnium (Hf)). Alloys of this type are known from EP 0 486 489 B1, EP 0 786 017 B1, EP 0 412 397 B1 or EP 1 306 454 A1.

The density is preferably 95% of the theoretical density.

A protective aluminum oxide layer (TGO=thermally grown oxide layer) is formed on the MCrAlX layer (as an intermediate layer or as the outermost layer).

The layer preferably has a composition Co—30Ni—28Cr—8Al—0.6Y—0.7Si or Co—28Ni—24Cr—10Al—0.6Y. In addition to these cobalt-based protective coatings, it is also preferable to use nickel-based protective layers, such as Ni—10Cr—12Al—0.6Y—3Re or Ni—12Co—21Cr—11Al—0.4Y—2Re or Ni—25Co—17Cr—10Al—0.4Y—1.5Re.

It is also possible for a thermal barrier layer, which is preferably the outermost layer and consists for example of $ZrO_2$, $Y_2O_3$—$ZrO_2$, i.e. unstabilized, partially stabilized or fully stabilized by yttrium oxide and/or calcium oxide and/or magnesium oxide, to be present on the MCrAlX.

The thermal barrier layer covers the entire MCrAlX layer.

Columnar grains are produced in the thermal barrier layer by suitable coating processes, such as for example electron beam physical vapor deposition (EB-PVD).

Other coating processes are possible, for example atmospheric plasma spraying (APS), LPPS, VPS or CVD. The thermal barrier layer may include grains that are porous or have micro-cracks or macro-cracks, in order to improve the resistance to thermal shocks. The thermal barrier layer is therefore preferably more porous than the MCrAlX layer.

Refurbishment means that after they have been used, protective layers may have to be removed from components 120, 130 (e.g. by sand-blasting). Then, the corrosion and/or oxidation layers and products are removed. If appropriate, cracks in the component 120, 130 are also repaired. This is followed by recoating of the component 120, 130, after which the component 120, 130 can be reused.

The blade or vane 120, 130 may be hollow or solid in form. If the blade or vane 120, 130 is to be cooled, it is hollow and may also have film-cooling holes 418 (indicated by dashed lines).

Figure 5:
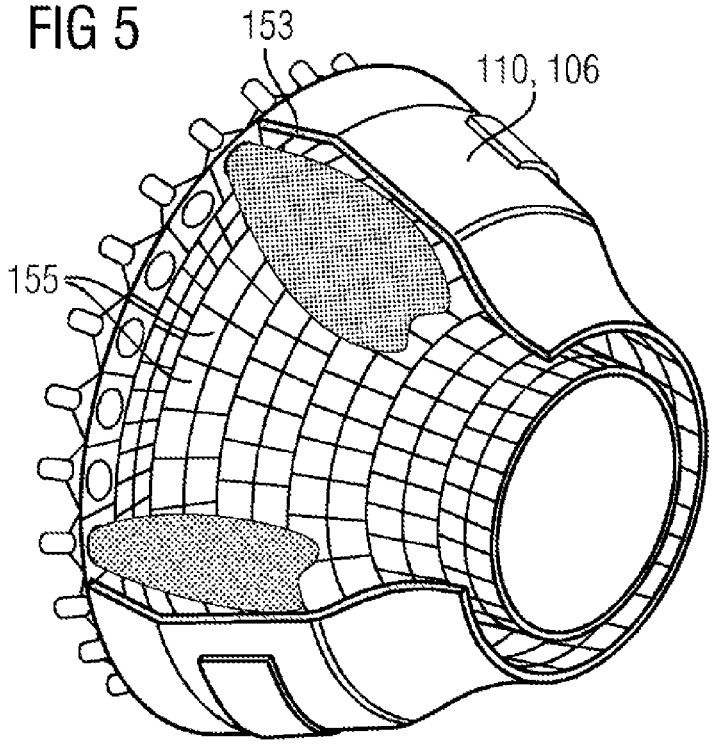
FIG. 5 shows a combustion chamber.

FIG. 5 shows a combustion chamber 110 of a gas turbine.

The combustion chamber 110 is configured, for example, as what is known as an annular combustion chamber, in which a multiplicity of burners 107, which generate flames 156 and are arranged circumferentially around an axis of rotation 102, open out into a common combustion chamber space 154. For this purpose, the combustion chamber 110 overall is of annular configuration positioned around the axis of rotation 102.

To achieve a relatively high efficiency, the combustion chamber 110 is designed for a relatively high temperature of the working medium M of approximately 1000° C. to 1600° C. To allow a relatively long service life even with these operating parameters, which are unfavorable for the materials, the combustion chamber wall 153 is provided, on its side which faces the working medium M, with an inner lining formed from heat shield elements 155.

On the working medium side, each heat shield element 155 made from an alloy is equipped with a particularly heat-resistant protective layer (MCrAlX layer and/or ceramic coating) or is made from material that is able to withstand high temperatures (solid ceramic bricks).

These protective layers may be similar to the turbine blades or vanes, i.e. for example MCrAlX:M is at least one element selected from the group consisting of iron (Fe), cobalt (Co), nickel (Ni), X is an active element and stands for yttrium (Y) and/or silicon and/or at least one rare earth element or hafnium (Hf). Alloys of this type are known from EP 0 486 489 B1, EP 0 786 017 B1, EP 0 412 397 B1 or EP 1 306 454 A1.

A for example ceramic thermal barrier layer, consisting for example of $ZrO_2$, $Y_2O_3$—$ZrO_2$, i.e. unstabilized, partially stabilized or fully stabilized by yttrium oxide and/or calcium oxide and/or magnesium oxide, may also be present on the MCrAlX.

Columnar grains are produced in the thermal barrier layer by suitable coating processes, such as for example electron beam physical vapor deposition (EB-PVD).

Other coating processes are conceivable, for example atmospheric plasma spraying (APS), LPPS, VPS or CVD. The thermal barrier layer may include grains that are porous or have micro-cracks or macro-cracks, in order to improve the resistance to thermal shocks.

Refurbishment means that after they have been used, protective layers may have to be removed from heat shield elements 155 (e.g. by sand-blasting). Then, the corrosion and/or oxidation layers and products are removed. If appropriate, cracks in the heat shield element 155 are also repaired. This is followed by recoating of the heat shield elements 155, after which the heat shield elements 155 can be reused.

A cooling system may also be provided for the heat shield elements 155 and/or their holding elements, on account of the high temperatures in the interior of the combustion chamber 110. The heat shield elements 155 are then for example hollow and may also have cooling holes (not shown) which open out into the combustion chamber space 154.

The invention claimed is:

1. A component of a gas turbine engine including a layer system, said layer system comprising:

a substrate, at least two layers comprising an inner layer and an outer layer, wherein the inner layer is on a boundary surface of the substrate, wherein the boundary surface of the substrate has both a roughness on the surface and an additional waviness to the surface that takes a sinusoidal form, wherein the roughness has roughness elevations and roughness depressions that define a roughness difference (R's) and the waviness has waviness peaks and waviness troughs that define a waviness difference ($R^4$i), and wherein the waviness difference ($R^4$i) is at least 20% greater than the roughness difference (R's);

and wherein a surface of the inner layer at an interface to the outer layer has both a roughness on the surface and an additional waviness to the surface that takes a sinusoidal form, wherein the roughness has roughness elevations and roughness depressions that define a roughness difference (Rs) and the waviness has waviness peaks and waviness troughs that define a waviness difference ($R^7$i), and wherein the waviness difference ($R^7$i) is at least 20% greater than the roughness difference (Rs).

2. The component as claimed in claim 1, wherein a layer thickness centerline of the inner layer is bent repeatedly.

3. The component as claimed in claim 2 wherein the inner layer is bent repeatedly at least 5 times and/or bent periodically at least in places.

4. The component as claimed in claim 1, wherein the substrate has a periodicity at least in places on its boundary surface.

5. The component as claimed in claim 4 wherein the periodicity is fully on its boundary surface.

6. The component as claimed in claim 1, wherein the waviness to the surface takes a uniform sinusoidal form with a periodic wave formation of at least 5 waves.

7. The component as claimed in claim 1, wherein the roughness difference (R's) is a mean roughness difference (Ra).

8. The component as claimed in claim 1, wherein the roughness difference (R's) is a root-mean-squared roughness difference (Rq).

9. The component as claimed in claim 1, wherein the waviness difference ($R^4$i) between a highest of the waviness peaks and a deepest of the waviness troughs of the boundary surface compared to the roughness difference (R's) between a highest of the roughness elevations and a lowest of the roughness depressions is at least 20%.

10. The component as claimed in claim 1, wherein a maximum distance between two adjacent roughness elevations of the boundary surface is d'i, wherein a smallest distance between two waviness peaks of the boundary surface is D'i, and wherein D'i is at least 20% greater than d'i.

11. The component as claimed in claim 1, wherein a maximum distance between two adjacent roughness elevations of the surface of the inner layer is di, wherein a smallest difference between two waviness peaks of the surface of the inner layer is Di, and wherein Di is at least 20% greater than di.

12. The component as claimed in claim 1, wherein the inner layer is a metallic bonding layer, to which an outer ceramic layer is applied.

13. The component as claimed in claim 1, wherein the substrate comprises at least one of a cobalt-based alloy and a nickel-based alloy.

14. A process for producing the component as claimed in claim 1, comprising:

producing the boundary surface of the substrate by laser machining.

15. A process for producing the component as claimed in claim 1, comprising casting the substrate to have the boundary surface to produce the additional waviness in the boundary surface.

16. The component as claimed in claim 1, wherein the outer layer is a thermal barrier layer and wherein columnar grains are produced in the thermal barrier layer by electron beam physical vapor deposition.

17. The component as claimed in claim 1, wherein the roughness of the surface of the inner layer is due to a coating process comprising a thermal coating processes.

18. The component as claimed in claim 1, wherein the roughness of the surface of the inner layer is due to a coating process comprising plasma spraying and/or HVOF.

19. The component as claimed in claim 1, wherein the waviness peaks and waviness troughs are configured such that the waviness difference ($R^4$i) is at least 30% greater than the roughness difference (R's).

20. The component as claimed in claim 1 wherein the inner layer is a metallic bonding layer comprising MCrAIX where M is at least one element selected from the group consisting of iron (Fe), cobalt (Co) and Nickel (Ni) and X is an active element comprising at least one of yttrium (Y), silicon, scandium (Sc), a rare earth element and halfnium (Hf).

21. The component as claimed in claim 1 wherein the waviness difference ($R^7$i) compared to the roughness difference (Rs) is at least 30%.

22. The component as claimed in claim 1 wherein the component of the gas turbine engine is one of a rotor blade and a guide vane.

23. The component as claimed in claim 1 wherein the component of the gas turbine engine is a component of a combustion chamber of the gas turbine engine.

24. The component as claimed in claim 1 wherein the roughness on the boundary surface is set in a targeted manner.

* * * * *